US006247343B1

(12) United States Patent
Weiss et al.

(10) Patent No.: US 6,247,343 B1
(45) Date of Patent: Jun. 19, 2001

(54) DEVICE FOR LOCKING AND UNLOCKING A DOOR, IN PARTICULAR A MOTOR VEHICLE DOOR

(75) Inventors: Karl-Ernst Weiss, Ettlingen; Bernd Weyerstall, Wuppertal, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/323,566

(22) Filed: Jun. 1, 1999

(30) Foreign Application Priority Data

May 30, 1998 (DE) ..... 198 24 427

(51) Int. Cl.[7] ..... E05B 47/00
(52) U.S. Cl. ..... 70/277; 292/336.3
(58) Field of Search ..... 70/277, 278.1; 292/DIG. 31, 336.3

(56) References Cited

U.S. PATENT DOCUMENTS

| | | | | |
|---|---|---|---|---|
| 3,725,939 | * | 4/1973 | Saltzstein | 70/277 |
| 3,993,338 | * | 11/1976 | Cherbourg et al. | 292/336.3 |
| 4,457,148 | * | 7/1984 | Johansson et al. | 70/278.1 |
| 4,805,427 | * | 2/1989 | Bates et al. | 70/264 |
| 4,910,980 | * | 3/1990 | Katoh | 70/277 |
| 5,295,374 | * | 3/1994 | Bender et al. | 70/277 |
| 5,497,641 | * | 3/1996 | Linde et al. | 70/277 |
| 5,743,575 | * | 4/1998 | McFarland | 292/336.3 |
| 5,844,470 | * | 12/1998 | Garnault et al. | 340/426 |
| 5,929,769 | * | 7/1999 | Garnault | 340/825.31 |

FOREIGN PATENT DOCUMENTS

| | | | | |
|---|---|---|---|---|
| 35 36 377 | | 4/1987 | (DE) . | |
| 37 12 376 | | 8/1988 | (DE) . | |
| 196 33 894 | | 2/1998 | (DE) . | |
| 0 218 251 | | 4/1987 | (EP) . | |
| 0 831 194 | | 3/1998 | (EP) . | |
| 649708 | * | 12/1928 | (FR) | 292/201 |

* cited by examiner

*Primary Examiner*—Lynne H. Browne
*Assistant Examiner*—John B. Walsh
(74) *Attorney, Agent, or Firm*—Kenyon & Kenyon

(57) ABSTRACT

A device for locking and unlocking a door, in particular a motor vehicle door, has an electric lock and a door handle, with the transmission of query information to a portable electronic authorization ID means being initiatable via a control unit provided for the door when the door handle is operated out of the resting position in opposite directions, with the authorization ID means causing the transmission of identification information on receipt of the query information, and with the control unit comparing the identification information received with predetermined authorized identification information and, if it agrees with some of the predefined identification information, the locking of the door or its unlocking with the release of the catch is executed or canceled by controlling the electric lock. The operating reliability of the system is greatly increased with simple handling due to the fact that the door handle can be swivelled up and down about a horizontal swiveling axis in a handle recess in the door, and it can be reset automatically into the starting center position again by spring elements after the door handle is released, and electric switches can be actuated in the switch positions of the door handle, initiating the identification and the locking procedure as well as the identification and the unlocking procedure.

11 Claims, 2 Drawing Sheets

DEVICE FOR LOCKING AND UNLOCKING A DOOR, IN PARTICULAR A MOTOR VEHICLE DOOR

FIELD OF THE INVENTION

The present invention relates to a device for locking and unlocking a door, in particular a motor vehicle door, with an electric lock and a door handle, in which transmission of query information to a portable electronic authorization ID means can be initiated via a control unit provided for the door on operation of the door handle in opposite directions out of the resting position, with the authorization ID means causing transmission of input identification information on receipt of the query information, and with the control unit comparing the identification information after receipt with predetermined authorized identification information and, if it agrees with some predetermined identification information, the locking of the door or its unlocking with the release of the catch is executed or canceled by controlling the electric lock.

BACKGROUND INFORMATION

A device is described in German Patent No. 35 36 377 and European Patent Application No. 218 251, where the door handle can be swivelled into and out of the handle recess provided for it. The swivelling axis is designed to be vertical. This known device initiates the identification and the unlocking procedure when the door handle is pulled, while the identification and the locking procedure can be initiated by pressing on the door handle. This device is not sufficiently reliable in operation, which can be a serious disadvantage, especially when using the device in a motor vehicle. The door handle can be inadvertently pushed inward, especially in an accident, which can then lead to inadvertent locking of the vehicle door if the authorization ID means is within the range of the query device of the control unit.

SUMMARY OF THE INVENTION

An object of the present invention is to improve upon a device so that it can be activated and deactivated only by predetermined operating measures that can hardly be initiated by accident, and therefore it functions much more reliably in operation.

This object is achieved according to the present invention by the fact that the door handle can be swivelled up and down about a horizontal swivelling axis in a handle recess provided in the door and it can be automatically reset back into the starting center position by spring elements after the door handle has been released, and electric switches can be operated in the switch positions of the door handle, initiating the identification and unlocking procedure with subsequent release of the door lock to open the door, as well as initiating the identification and locking procedure.

This embodiment of the door handle and the device requires vertical swivelling of the door handle, which is much more difficult to implement, at least with regard to inadvertent operation, than a horizontal movement of the door handle, e.g., due to grazing an object which strikes the door handle.

To increase the reliability in operation, the design may be such that when the door handle is swivelled upward, the switch that is operated initiates the identification and the unlocking or door opening procedure, and when the door handle is swivelled downward, the switch that is operated initiates the identification and the locking procedure, and in the starting center position, the door handle is arranged flush or countersunk in the handle recess, with the edges of the recess providing protection from accidental movement of the door handle.

The design of the handle recess is preferably such that it is oval in shape and is oriented with its longitudinal axis being horizontal. A design which is even more secure against unintentional operation provides for the door handle to be countersunk in the handle recess. The outstanding edges of the handle recess then offer protection against unintentional deployment.

Automatic resetting of the door handle in its starting position is easily achieved due to the fact that the door handle has a neck which is lengthened beyond the swivelling axis and extends further into the door, and two spring elements acting in opposite directions are mounted on this neck. These spring elements are accommodated vertically in the door, with the neck on the door handle being arranged symmetrically with the horizontal center plane of the door handle when the latter is in the starting center position.

The switch points are integrally molded on a part of the door handle which is displaced further into the door with respect to the swivelling axis.

An especially advantageous design is characterized in that the door handle can be moved out of the latched resting position in both adjustment directions by an actuating force.

The swivelling axis of the door handle is preferably located behind the handle recess, i.e., in the door. The recess itself is designed to be symmetrical with the horizontal center plane of the door handle when the latter is in the starting center position, so that gripping the door handle from above and below for swivelling the door handle is facilitated.

If, according to another embodiment, the door handle is designed in a bow shape with both legs inserted into the door, and the switches, the spring elements, the neck and the switch points are provided for one of these legs, then the door handle can be gripped better when swiveling, and the exterior door panel need only have two small passages for inserting the legs of the bow-shaped door handle.

DETAILED DESCRIPTION

Figure 1:
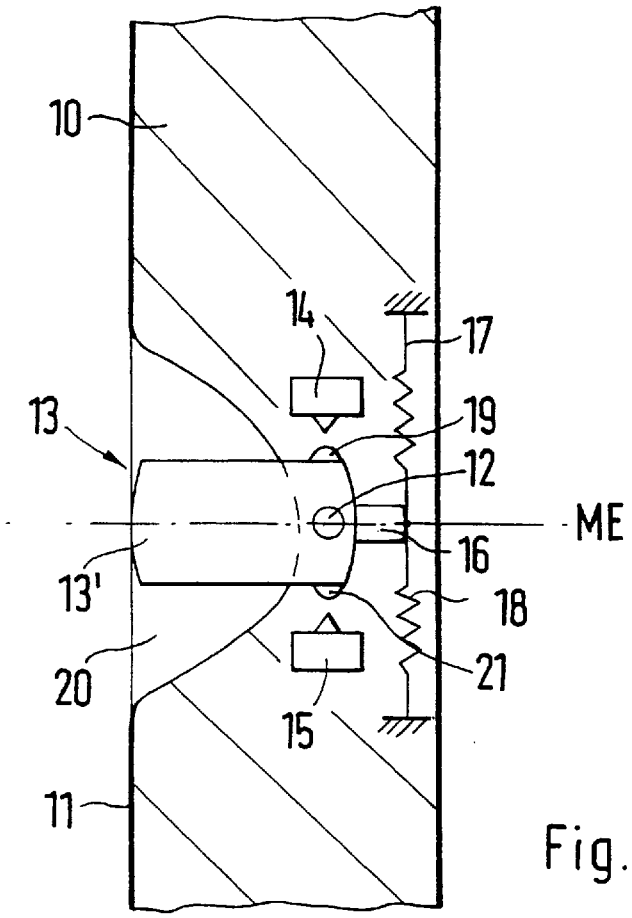
FIG. 1 shows a vertical section through a vehicle door in the area of the door handle.

As shown by the section according to FIG. 1, a handle recess 20 which is oval and oriented with its longitudinal axis being horizontal is provided for the door handle in exterior door panel 11 of vehicle door 10, as shown by the view in FIG. 1. Other shapes and embodiments of handle recess 20 are also possible.

A door handle 13 is mounted in handle recess 20 so that it is oriented horizontally and can be swivelled, as shown by swivelling axis 12. Swivelling axis 12 is located behind handle recess 20 in vehicle door 10. Door handle 13 is flush with the edges of exterior door panel 11 enclosing handle recess 20 and thereby greatly reducing the risk of it being inadvertently swivelled up or down, in particular when the vehicle grazes a stationary object. Door handle 13 may also be arranged countersunk in handle recess 20 to further increase the security against inadvertent swivelling of door handle 13.

Door handle 13 is extended beyond swivelling axis 12 into vehicle door 10 and has a neck 16 on which are mounted two vertically oriented spring elements 17 and 18. If door handle 13 is swivelled out of the starting center position shown here into lower switch position Su, then switch point 19 on door handle 13 activates electric switch 14. This switch 14 initiates the identification and the locking procedure in the passive entry system with the electric lock. However, if door handle 13 is pushed upward, then switch point 21 on door handle 13 activates switch 15. This switch 15 initiates the identification and the unlocking and opening procedure in the passive entry system with the electric lock. When door handle 13 is released, spring element 18 or 17 ensures the automatic return of door handle 13 back to its starting center position, where door handle 13 can be latched, and it can be displaced out of this position only by an actuating force.

Figure 2:
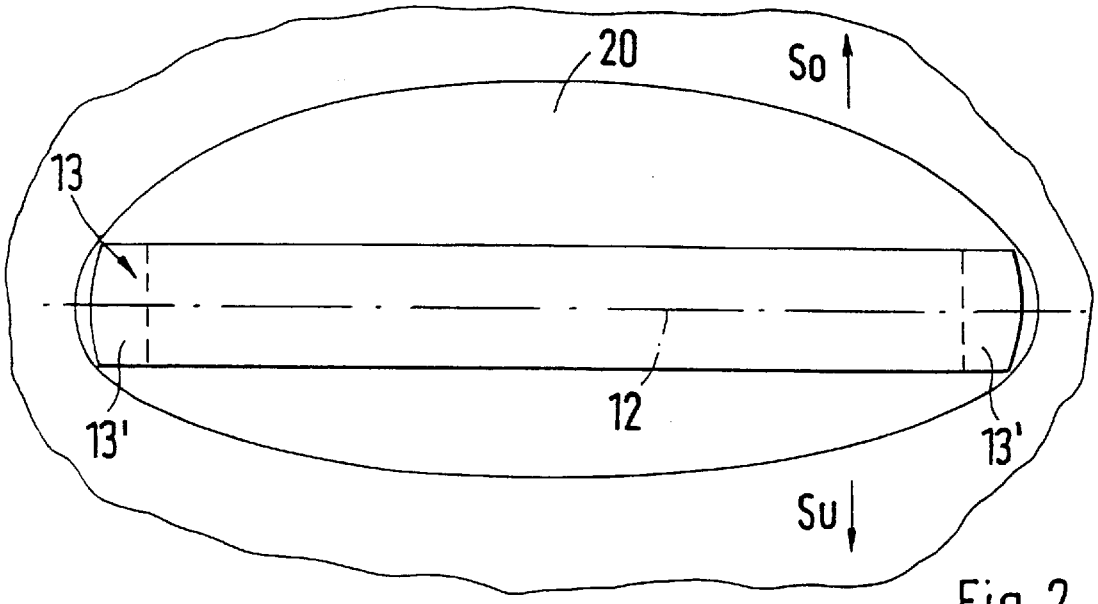
FIG. 2 shows a view of the outside of the vehicle door with the built-in door handle.

As shown with dotted lines in FIG. 2, door handle 13 may also be designed in a U shape or a bow shape with two legs 13'. Then only legs 13' are inserted through exterior door panel 11 into vehicle door 10. Switches 14 and 15 and spring elements 17 and 18 are provided for one leg 13', which then assumes the function of neck 16 and switch points 19 and 21. In this embodiment, door handle 13 can be gripped better when swivelling and in particular when opening the door.

Figure 3:
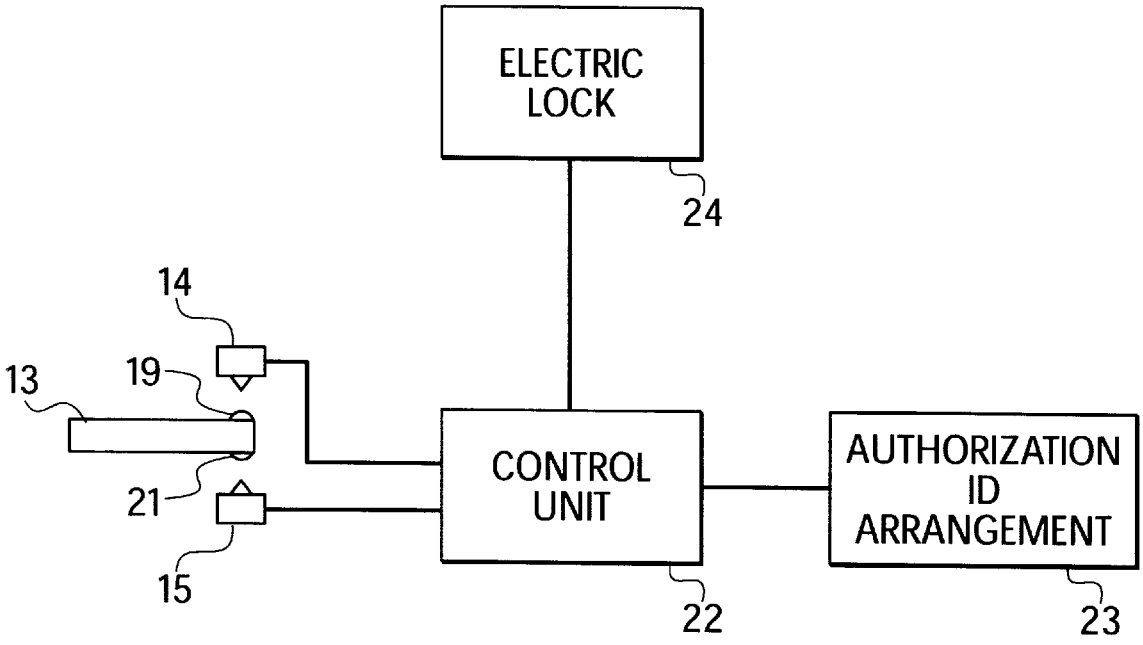
FIG. 3 shows a schematic diagram of the invention.

As can be seen in FIG. 3, when door handle 13 is swivelled out of its starting center position and switch points 19 or 21 contacts switches 14 or 15, control unit 22 initiates the transmission of a query to authorization ID arrangement 23, which responds by transmitting identification information back to control unit 22. Upon receiving the identification information from authorization ID arrangement 23, control unit 22 compares the returned identification information with predetermined authorized identification information, and, if the identification information received from authorization ID arrangement 23 agrees with the predetermined authorized identification information, control unit 22 controls electric lock 24 to execute or cancel the locking or unlocking of the door.

What is claimed is:

1. A locking device, comprising:

a door;

a handle depression in the door;

a control unit associated with the door;

an electric lock coupled to the control unit;

a portable electronic authorization ID arrangement;

a door handle, wherein the door handle is adapted to be swivelled up out of a starting center position into an up position, and swivelled down out of the starting center position into a down position, about a horizontal swivelling axis in the handle depression in the door;

wherein, upon an operation of the door handle out of the starting center position into one of the up and down positions, the control unit initiates a transmission of query information to the authorization ID arrangement, the authorization ID arrangement causes a transmission of identification information to the control unit upon receiving the query information from the control unit, the control unit compares the identification information with predetermined authorized identification information, and, if the identification information received from the authorization ID arrangement agrees with the predetermined authorized identification information, the control unit controls the electric lock to execute or cancel one of a locking or an unlocking of the door;

a first spring element for automatically resetting the door handle into the starting center position after the door handle is released from the up position;

a second spring element for automatically resetting the door handle into the starting center position after the door handle is released from the down position; and electric switches for initiating, on the one hand, an identification procedure and a locking procedure and, on the other hand, an identification procedure and an unlocking procedure, the electric switches being actuated in switch positions of the door handle.

2. The device according to claim 1, wherein the door handle is adapted to be moved out of a latched resting position in two adjustment directions by an actuating force.

3. The device according to claim 1, wherein, when the door handle is swivelled downward, one of the switches that is operated initiates the identification procedure and the locking procedure, and when the door handle is swivelled upward, another one of the switches that is operated initiates the identification procedure and the unlocking procedure and an opening procedure.

4. The device according to claim 1, wherein, in the starting center position, the door handle is arranged flush or countersunk in the handle depression.

5. The device according to claim 1, wherein the handle depression is oval and is situated with a longitudinal axis being horizontal.

6. The device according to claim 1, wherein the door handle has a neck which is extended beyond the swivelling axis and extends further into the door, and the first and second spring elements which act in opposite directions are mounted on the neck.

7. The device according to claim 6, wherein the spring elements are accommodated in the door so that the first and second spring elements are vertically oriented, and the neck is situated on the door handle so that the neck is symmetrical with a horizontal center plane.

8. The device according to claim 1, wherein the electric switches are situated in an area of the handle depression in the door so that the electric switches are actuated by switch points integrally molded on the door handle with respective swivelling movements of the door handle.

9. The device according to claim 8, wherein the switch points are integrally molded on a part of the door handle which is located farther inside the door in comparison with the swivelling axis.

10. The device according to claim 1, wherein the swivelling axis of the door handle is arranged behind the handle depression in the door, and the handle depression is symmetrical with a horizontal center plane of the door handle in the starting center position.

11. The device according to claim 1, wherein the door handle has a bow shape and two legs inserted into the door, and the switches, the first and second spring elements, a neck and switch points are assigned to one of the legs.

* * * * *